US007572212B2

(12) United States Patent
Cassidy et al.

(10) Patent No.: US 7,572,212 B2
(45) Date of Patent: Aug. 11, 2009

(54) PORTABLE WEIGHTLIFTING APPARATUS

(75) Inventors: Daniel Cassidy, LaJolla, CA (US); Patrick Locke, Chula Vista, CA (US)

(73) Assignees: Daniel T. Cassidy, La Jolla, CA (US); Julius Patrick Locke, Chula Vista, CA (US)

( * ) Notice: Subject to any disclaimer, the term of this patent is extended or adjusted under 35 U.S.C. 154(b) by 0 days.

(21) Appl. No.: 11/969,960

(22) Filed: Jan. 7, 2008

(65) Prior Publication Data

US 2008/0171642 A1 Jul. 17, 2008

Related U.S. Application Data

(60) Provisional application No. 60/878,839, filed on Jan. 5, 2007.

(51) Int. Cl.
*A63B 21/062* (2006.01)

(52) U.S. Cl. ..... 482/102; 482/904

(58) Field of Classification Search ..... 482/33, 482/102, 904, 93, 94, 98, 99, 103
See application file for complete search history.

(56) References Cited

U.S. PATENT DOCUMENTS

| | | | | | |
|---|---|---|---|---|---|
| 321,388 | A * | 6/1885 | Ruebsam | 482/102 |
| 323,792 | A * | 8/1885 | Coop et al. | 482/102 |
| 325,404 | A | 9/1885 | Forest | |
| 382,440 | A * | 5/1888 | Sanchez | 482/102 |
| 550,620 | A * | 12/1895 | Jones | 119/782 |
| 840,227 | A | 1/1907 | Brush | |
| 848,272 | A * | 3/1907 | Thornley | 482/102 |
| 2,949,110 | A * | 8/1960 | Lee | 602/33 |
| 3,189,004 | A * | 6/1965 | Sinclair | 119/789 |
| 3,559,987 | A * | 2/1971 | Pear | 482/94 |
| 3,717,342 | A | 2/1973 | Haney | |
| 3,840,227 | A | 10/1974 | Chesemore | |
| 3,861,675 | A | 1/1975 | Hopper | |
| 3,966,203 | A * | 6/1976 | Bickford | 482/103 |
| 4,243,219 | A | 1/1981 | Price | |
| 4,344,618 | A | 8/1982 | Dudley | |
| 4,353,546 | A * | 10/1982 | Rhoades | 482/94 |
| 4,685,670 | A * | 8/1987 | Zinkin | 482/129 |
| 4,809,973 | A * | 3/1989 | Johns | 482/99 |
| 4,826,153 | A | 5/1989 | Schalip | |
| 4,968,026 | A * | 11/1990 | Granado | 482/102 |
| 5,072,934 | A | 12/1991 | Blanes | |
| 6,494,817 | B2 | 12/2002 | Lake | |
| 6,666,800 | B2 * | 12/2003 | Krull | 482/94 |
| 2001/0046928 | A1 * | 11/2001 | Nette | 482/55 |

* cited by examiner

*Primary Examiner*—Loan H Thanh
*Assistant Examiner*—Victor K Hwang
(74) *Attorney, Agent, or Firm*—Kremblar, Foster, Phillips & Pollick; Jason Foster

(57) ABSTRACT

A portable weightlifting device having a segmented, separable, tubular housing that can be quickly and easily assembled and disassembled by a single user. The housing contains a movable weight that is coupled to a user interface outside of the housing by a cable that traverses two pulleys. One of the pulleys can be adjustably positioned for allowing a user to perform a multitude of exercises.

1 Claim, 9 Drawing Sheets

PORTABLE WEIGHTLIFTING APPARATUS

BACKGROUND OF THE INVENTION

1. Field of the Invention

This invention relates generally to the field of exercising devices and relates more particularly to a portable weightlifting device having a segmented, separable housing that can be quickly assembled and disassembled.

2. Description of the Related Art

Many portable resistance training devices that are currently available incorporate conventional stretch cords or stretch bands. These devices are typically lightweight and consist of at least one elongated, elastomeric member having a handle or other user interface on one end, and another handle or a means for removably attaching the device to a stable structure on the opposite end. During operation, the user elongates the elastomeric member by pulling on it, and the resistance provided by the elastomeric member increases as the user stretches the member, and decreases as the user allows the member to unstretch. While these devices are sometimes preferred for their portability and ease of use, the variation of resistance over the device's range of motion can be undesirable. This is especially true in the contexts of physical therapy and athletic training, because the variation of resistance poorly approximates the forces that act upon a human's body when engaging in many routine and sports-related activities.

Traditional weight machines that use cables, pulleys and weights provide a user with consistent resistance over the machine's entire range of motion, but they are generally far too heavy to be easily transported. Free weights are lighter and more portable than weight machines, but they often must be used in conjunction with heavy benches or seats in order to properly isolate a user's muscles for a variety of exercises. Free weights are also prone to causing damage to walls and flooring adjacent a user.

It is therefore desirable to have a portable resistance training device that provides substantially consistent resistance over the device's range of motion, and is highly portable and easy to set up.

BRIEF SUMMARY OF THE INVENTION

In accordance with the present invention, there is provided a portable weightlifting device having an elongated, tubular housing that is preferably about 8 feet in length. The housing is preferably separable into three segments of equal length for convenient portability. The housing can be quickly assembled at a desired location by a single user, and can be quickly disassembled and stored in a bag or case for transport.

When assembled and configured for use, the housing stands upright with its bottom end seated on a flat surface. Preferably, the housing is provided with at least two fastening straps for removably mounting the housing to adjacent structures, such as doors and fences, for stability during use. The device is also provided with several tie-down ropes and ground stakes for securing the housing in a free-standing configuration.

The housing has a first aperture adjacent its top end. A first pulley is mounted to the housing adjacent the first aperture. A cylindrical weight is disposed within the housing. A flexible member, such as a nylon rope, is removably mounted to the top of the weight. The flexible member extends upwardly from the weight, operatively engages the first pulley, and extends through the first aperture. The member terminates in a user interface, such as a handle or a cuff.

A second pulley is adjustably mounted between the first pulley and the user interface for operatively engaging and variably redirecting the flexible member. The second pulley can be removably attached to any one of several fastening rings on the housing, or to a structure adjacent the housing, such as a fence, for accommodating a multitude of exercises. For example, the second pulley can be attached to a fastening ring adjacent the bottom end of the housing, thus redirecting the flexible member upwardly to the hand of a standing user for allowing the user to perform a bicep curl. Alternatively, the second pulley can be omitted, with only the first pulley being used, for allowing a user to perform a pull-down exercise, such as a tricep pull-down, a cable crunch, or an assistive shoulder exercise.

Preferably, the housing has a second aperture adjacent its bottom end for allowing access to the weight, thus allowing the amount of weight to be conveniently changed. A securable cover preferably fits over the second aperture for preventing external elements from entering into the housing.

Figure 1:
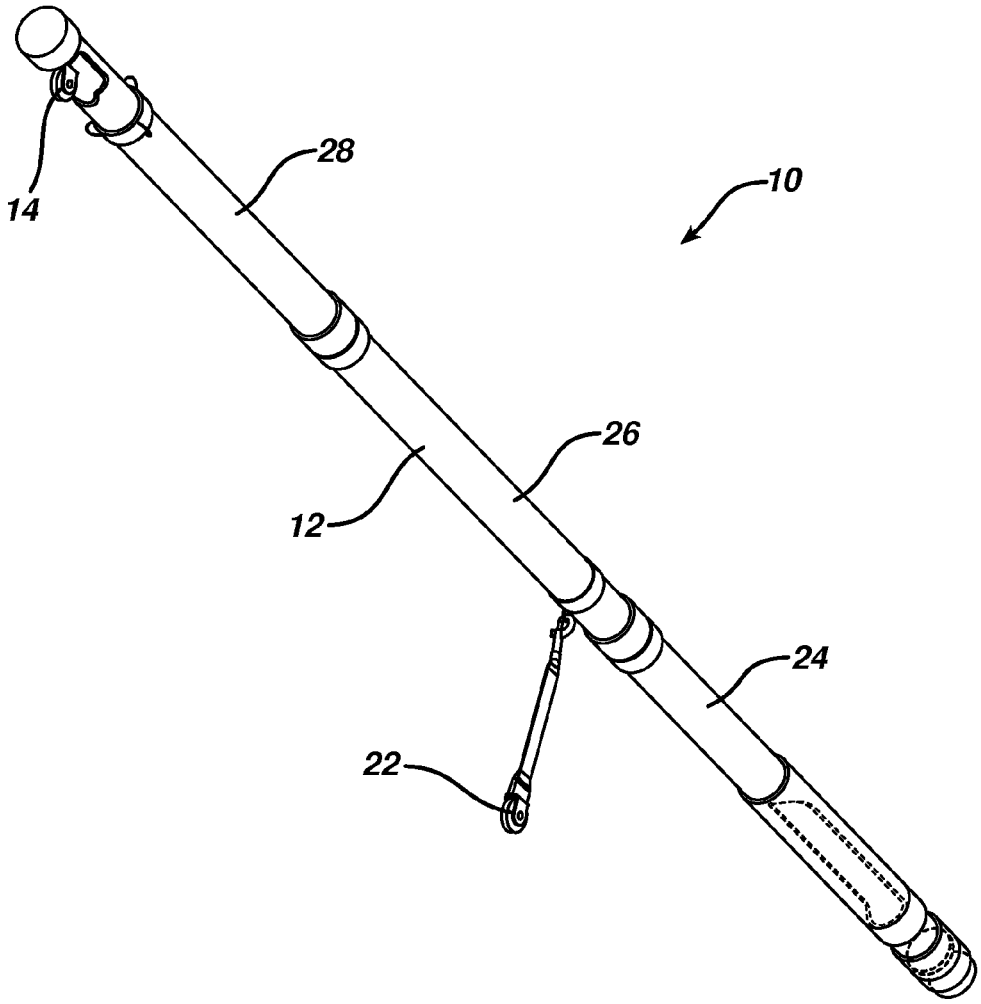
FIG. 1 is a perspective view illustrating an embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Referring to FIGS. 1-4, the portable weightlifting device 10 is generally provided with a housing 12, a first pulley 14, a weight 16, a flexible member 18, a user interface 20, and a second pulley 22. The housing 12 is an elongated, tubular body that is preferably fabricated from conventional polyvinyl chloride (PVC) tubing. Of course, all other sufficiently rigid and lightweight materials, such as aluminum, steel, and other plastics and composites are contemplated. The length of the housing 12 is in the range of about 5 feet to about 20 feet, and is preferably in the range of about 7 feet to about 12 feet.

The inner diameter of the housing 12 is in a range of about 3 inches to about 10 inches, and is preferably in a range of about 4 inches to about 6 inches. Although it is preferred that the housing 12 be formed of a circular cylindrical tubing, it is contemplated that the tubing may have any other cross-sectional shape, such as rectangular or triangular.

The housing 12 is axially separable into a bottom segment 24, a middle segment 26, and a top segment 28. It is preferred that the segments 24, 26, and 28 be of about equal length, and that each segment have a length not exceeding about 3 feet for maintaining convenient portability of the device 10. Embodiments of the device 10 are contemplated that incorporate housings that are separable into more or less than 3 segments of equal or unequal length. For example, a 14 foot long housing can be separable into 4 segments of 3 feet and 1 segment of 2 feet, and a six foot long housing can be separable into 2 equal segments of 3 feet.

Figure 2:
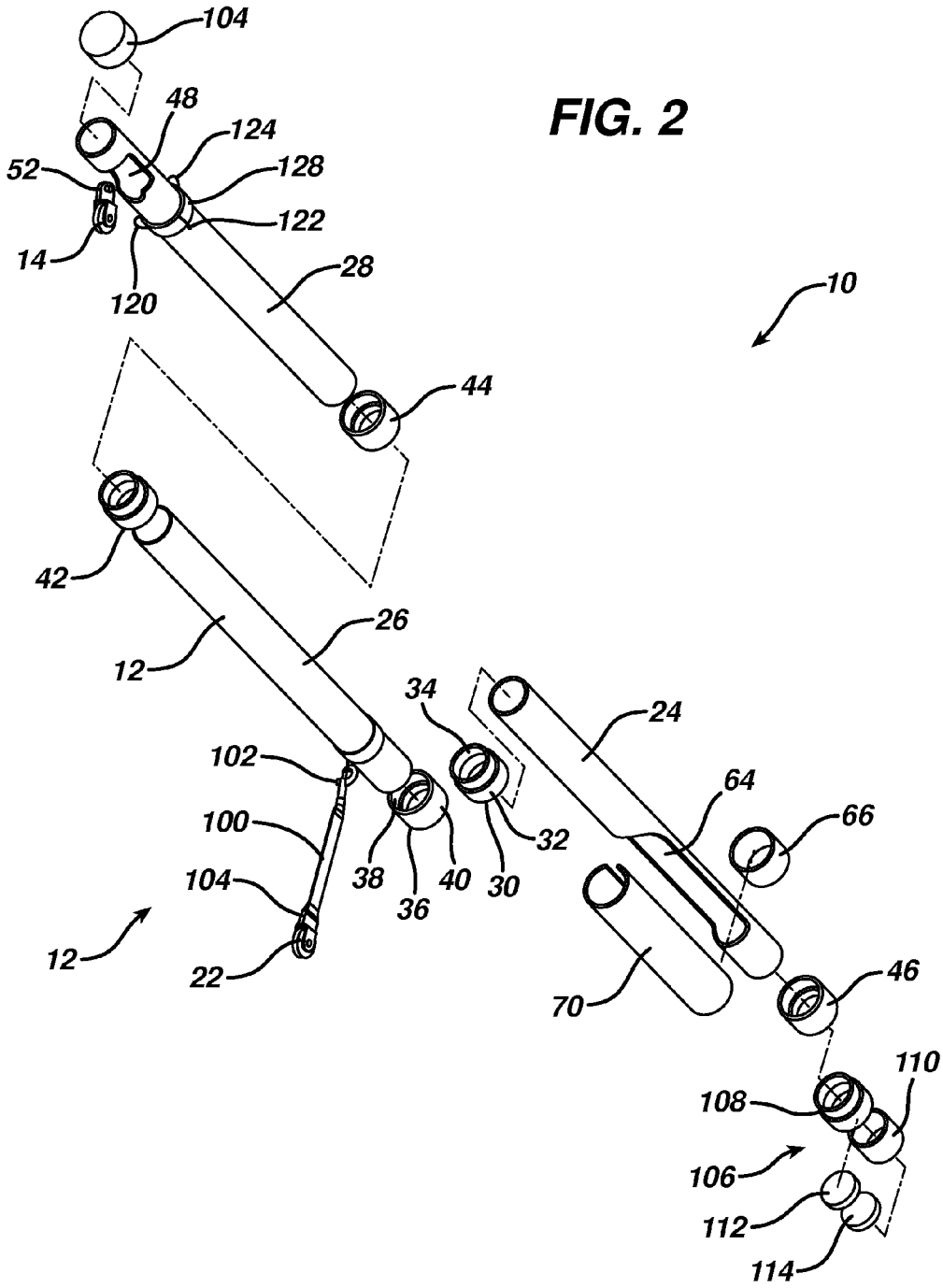
FIG. 2 is an exploded perspective view illustrating an embodiment of the present invention.

Referring to FIG. 2, a conventional, threaded male pipe adapter 30 is mounted to the top end of the bottom segment 24. The adapter 30 has a mounting portion 32 and a connecting portion 34. The mounting portion 32 fits over, and is securely affixed to, the bottom segment 24, preferably with silicon adhesive. Although silicon adhesive is preferred, all other means of securing the adapter to the bottom segment, such as with fasteners or with other adhesives, or by press-fitting or snap-fitting, are contemplated. The connecting portion 34 of the male adapter 30 has a threaded exterior surface and an interior diameter that is substantially equal to the interior diameter of the bottom segment 24. The connecting portion 34 thus axially abuts the top end of the bottom segment 24 to form a contiguous, cylindrical interior surface traversing both components.

A conventional female pipe adapter 36 is mounted to the bottom end of the middle segment 26. The female adapter 36 has a mounting portion 38 and a receiving portion 40. The mounting portion 38 fits over, and is secured to, the middle segment 26 in a manner identical to the mounting portion 32 of the male adapter 30 described above. The receiving portion 40 of the female adapter 36 has a threaded interior surface for threadedly engaging the threaded connecting portion 34 of the male adapter 30. Thus, the middle segment 26 attaches to the bottom segment 24 by threading the respective surfaces together.

Still referring to FIG. 2, a second conventional male pipe adapter 42 and a second conventional female pipe adapter 44 are mounted to the top end of the middle segment 26 and the bottom end of the top segment 28, respectively, in a manner identical to the adapters 30 and 36 described above. A third conventional female pipe adapter 46 (described in greater detail below) is mounted to the bottom end of the bottom segment 24 in a manner similar to the female pipe adapters described above. The connectivity of the male adapters and the female adapters allows the housing 12 to be quickly and easily assembled and disassembled for convenient portability of the device 10. It is contemplated that the male adapters 32 and 42 can be omitted, and that threads can be formed directly on the exteriors of the three segments 24, 26, and 28 for engaging the receiving portions of the female adapters 36 and 44. Although threaded engagement is the preferred means of removably mounting the segments to one another, all other means of attachment that would similarly provide the assembled housing 10 with sufficient axial rigidity and a substantially contiguous, cylindrical interior surface, such as by snap-fitting or exterior coupling, are contemplated.

Referring to FIGS. 1 and 2, a pulley aperture 48 is formed in the top segment 28 of the housing 10 adjacent the top end of the segment 28. The first pulley 14 is positioned within, and partially protrudes from, the pulley aperture 48. The first pulley 14 has a mounting portion 52 that is welded to the interior surface of the top segment 28. Although welding is preferred, all other means for securing the pulley 14 to the interior of the segment 28, such as by conventional fasteners or adhesives, are contemplated. It is further contemplated that the first pulley 14 can be mounted to the exterior of the housing 10 adjacent the pulley aperture 48. The pulley 14 rotates about an axis that is part of the mounting portion 52, and is positioned in the pulley aperture 48 to permit movement relative to the housing 12.

Figure 3:
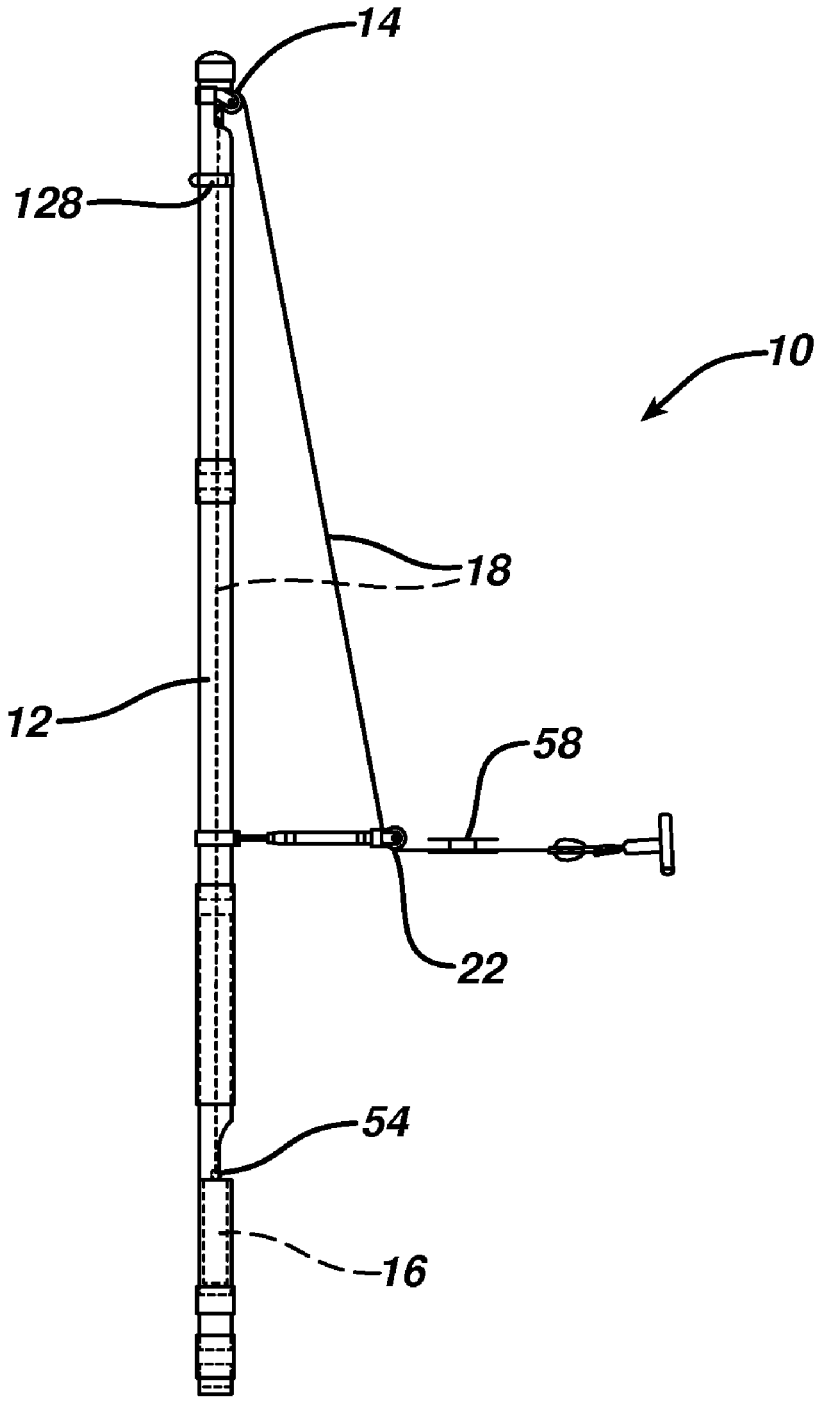
FIG. 3 is a side elevation view illustrating an embodiment of the present invention.
Figure 4:
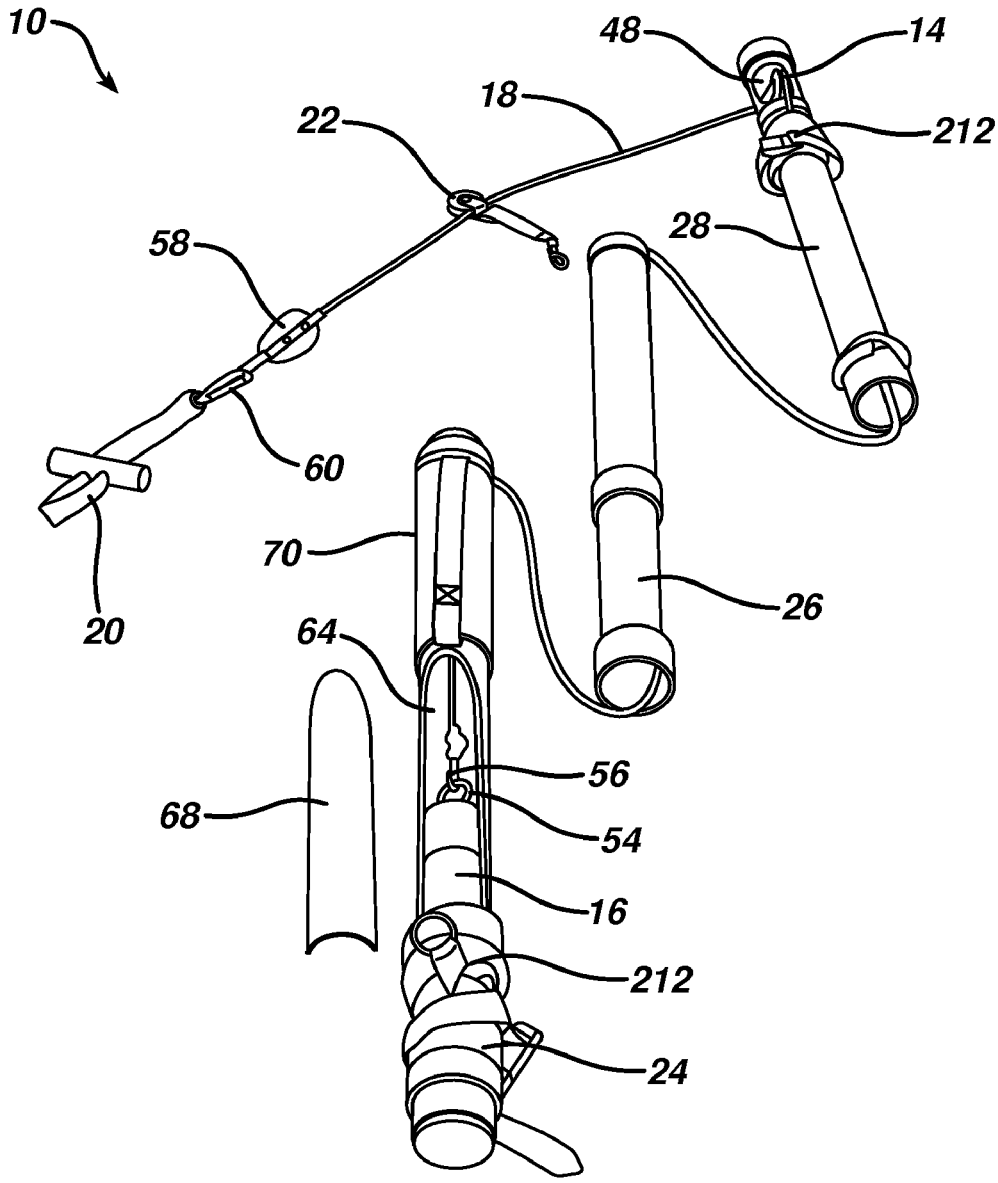
FIG. 4 is a perspective view illustrating an embodiment of the present invention in an unassembled state.

Referring now to FIGS. 3 and 4, the weight 16 is cylindrical and is positioned within the housing 12. The outer diameter of the weight 16 is small enough to allow the weight 16 to slide longitudinally within housing 12 without substantial hindrance, but is large enough to prevent the weight 16 from swaying excessively relative to the housing's interior surface. Preferably, the weight 16 has an exterior shape that substantially matches the shape of the housing's 12 interior. The weight 16 is made from lead, although it is contemplated that any material or physical composition that is suitably heavy, such as an iron block or a bag of lead pellets, can alternatively be used. The weight 16 weighs 6 pounds, although weights that are heavier or lighter than 6 pounds are contemplated. A maximum weight of 20 pounds is preferred for maintaining convenient portability of the device.

A weight ring 54 extends from the top of the weight 16. The flexible member 18, which is preferably a rope or cable, is removably fastened to the weight ring 54 by a conventional bolt snap 56. The flexible member 18 extends from the bolt snap 56 upwardly through the central interior of the housing 12 and engagingly traverses the top of the first pulley 14. The pulley 14 redirects the flexible member 18 downwardly as the flexible member 18 exits the housing 12 through the pulley aperture 48. The flexible member 18 terminates in a spool 58, and a conventional carabiner clip 60 is used to connect the spool 58 to the user interface 20. The user interface 20 shown in FIG. 4 is a conventional cable machine handle, although it is contemplated that the interface can be any of a variety of conventional cable machine attachments that will be recognized by those skilled in the art, including a lateral bar, a curl bar, or an ankle cuff. The term "user interface" is defined herein as a structure that the user of the device 10 engages to enable the user to apply a tensile force to the flexible member 18.

Still referring to FIGS. 3 and 4, a longitudinally elongated weight aperture 64 is formed in the bottom segment 24 of the housing 12 for allowing access to the juncture of the flexible member 18 and the weight 16. A user may thus reach through the aperture 64, detach the bolt snap 56 from the weight ring 54, remove the weight 16 from the housing 12, insert a different weight into the housing 12, and attach the bolt snap 56 to the weight ring of the new weight. The weight aperture 64 is formed by cutting away a portion of the bottom segment 24. Preferably, the aperture 64 extends at least halfway around the housing's circumference so that the aperture 64 is sufficiently large to allow the weight 16 to be easily removed from, and inserted into, the housing 12. It is contemplated that the weight aperture 64 can be omitted, and that the weight 16 can instead be accessed through the pulley aperture 48, or either end of the segments 24 and 26.

Referring back to FIG. 2, a bracing collar 66 fits around the housing 12 adjacent the bottom edge of the weight aperture 64. The collar 66 has an interior diameter that is substantially equal to the outer diameter of the housing 12. The collar 66 provides the housing 12 with added structural rigidity to prevent the bottom segment 24 from buckling at or adjacent the weight aperture 64. The bracing collar 66 is formed of PVC tubing, although all other sufficiently rigid and durable materials, such as aluminum and steel, are contemplated.

Referring now to FIG. 4, a weight door 68 fits over the weight aperture 64 for preventing external elements, such as water and debris, from entering the housing 12. The door 68 is a shim formed of the portion of bottom segment 24 that was cut away to create the weight aperture 64 (described above). The door 68 thus matingly engages the housing 12 to form the original, cylindrical interior and exterior surfaces of the bottom segment 24. It is contemplated that the door 68 can be hingedly mounted to the housing 12 adjacent the weight aperture 64 for allowing the door 68 to be pivotably opened and closed.

Referring to FIGS. 2 and 4, a retaining collar 70 engages the bottom segment 24 of the housing 12 for releasably holding the weight door 68 in place in the aperture 64. The collar 70 is formed of a segment of PVC tubing that is identical to the tubing used to construct the segments of the housing 12, although the collar 70 is longitudinally slit and expanded to allow the collar 70 to fit around and slidably engage the bottom segment 24. It is contemplated that the collar 70 can alternatively be formed of a segment of tubing that is not slit or expanded, but that instead has an interior diameter that is larger than the exterior diameter of the bottom segment 24. When the retaining collar 70 is in a closed position, it abuttingly rests atop the bracing collar 66 and covers the weight door 68. In order to move the collar 66 to an open position, a user manually slides the collar upwardly to fully expose the weight door 68.

Figure 6:
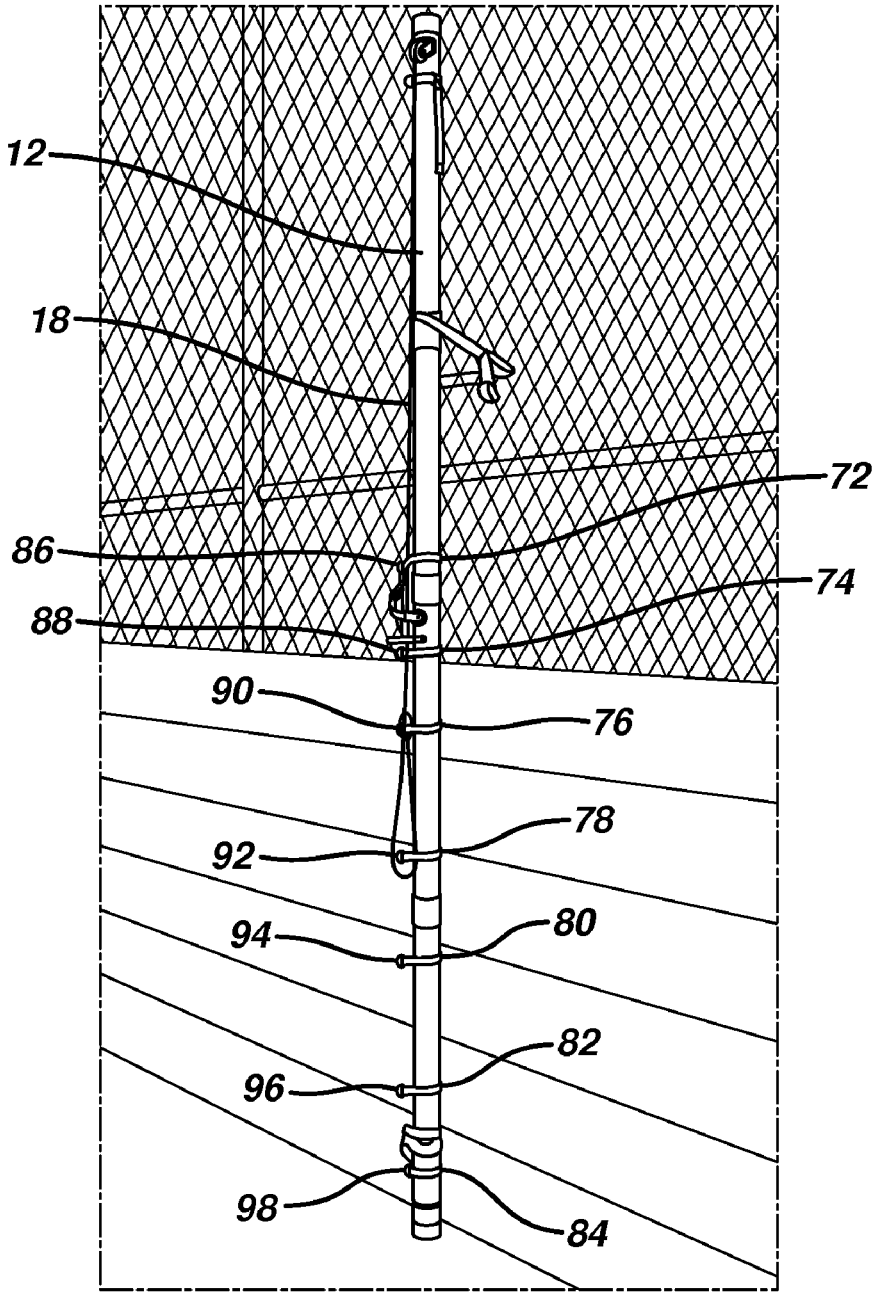
FIG. 6 is a perspective view illustrating an embodiment of the present invention mounted to an adjacent structure.

Referring to FIG. 6, seven fastening rings 72, 74, 76, 78, 80, 82, and 84 are mounted to the housing 12 by seven corresponding nylon fastening collars 86, 88, 90, 92, 94, 96, and 98. The fastening collars 86-98 snugly engage the exteriors of the middle and bottom segments 26 and 24 at different longitudinal positions. Friction prevents each of the collars 86-98 from freely sliding longitudinally relative to the housing 12, although a moderate amount of force applied manually by a human is sufficient to longitudinally displace any of the collars 86-98. If desired, adhesive or fasteners can be used to prevent relative movement. The fastening rings 72-84 are conventional D-rings, although it is contemplated that any similar ring, loop, or hook-like structures can be substituted in their place. It is further contemplated that the fastening collars 86-98 may be entirely omitted and that rings, loops, or hooks can alternatively be formed or mounted directly on the exterior surface of the housing 12.

Referring now to FIGS. 2 and 6, the second pulley 22 is substantially identical to the first pulley 14, and is configured to be mounted to the housing 12 or to an adjacent structure. A mounting strap 100 terminating in a bolt snap 102 is rigidly attached to the mounting portion 104 of the second pulley 22. The strap 100 and the bolt snap 102 are used to removably attach the second pulley 22 to any one of the longitudinally disposed fastening rings 72-84. The pulley 22 can alternatively be attached to a structure adjacent the housing 12, such as the fence shown in FIG. 6, or any sufficiently sturdy structure. The pulley 22 can thus engage the flexible member 18 at a variety of positions for adjustably redirecting the member 18 as shown, in one example, in FIG. 3. The second pulley 22 is, when in use, between the first pulley and the user. The word "between" is defined herein to mean interposed along the flexible member 18 with the pulley 14 at one side and the user at another side, and not necessarily on a straight line connecting the pulley 14 and the user.

In another example, when the second pulley 22 is attached to the bottom-most fastening ring 98, the flexible member 18 engagingly traverses the bottom of the second pulley 22 and is redirected upwardly to the hand of a standing user. This configuration is useful for accommodating exercises that require a user to provide a substantially upwardly-directed force, such as a bicep curl. In still another example, the second pulley 22 can be attached to the top-most fastening ring 86 for accommodating exercises that require a user to provide a substantially horizontally-directed force, such as a fly. In yet another example, the second pulley 22 can be left unattached, with only the first pulley 14 being used for accommodating exercises that require a user to provide a substantially downwardly-directed force, such as a tricep pull-down.

Referring to FIGS. 3 and 4, the flexible member 18 is preferably of sufficient length to traverse both the first pulley 14 and the second pulley 22 and to allow a user to be positioned at least 5 feet from the housing 12 when performing any exercise. Any excess length of the flexible member 18 is wrapped around the spool 58. The flexible member 18 is preferably a conventional nylon rope, although it is contemplated that all other types of substantially inelastic ropes, cords, and cables that are conventionally used with traditional cable machines, such as composite plastic or steel cables, can alternatively be used. The term "flexible" is defined herein as being able to bend, such as around a pulley, but substantially inelastic, such as a metal cable, for example.

Referring back to FIG. 2, an end cap 104 fits over the top end of the top segment 28 of the housing 12 for preventing the entry of external elements, such as water and debris. The end cap 104 is preferably affixed to the top segment 28 with silicon adhesive, although all other means of securing the cap 104 to the segment, such as fasteners or other adhesives, or by press-fitting or snap-fitting, are contemplated. It is further contemplated that the cap 104 may be entirely omitted, or that the top segment 28 may alternatively be formed with a closed top end.

During operation, the device 10 must be firmly stabilized in an upright orientation so that the housing 12 will not shift or tilt when lateral forces are applied to it, typically by the mounting portion 52, when a tensile force is applied to the flexible member 18. Several means are thus provided for stabilizing the device 10. The particular means selected will depend on the type of surface on which the housing 12 will be standing and whether the housing 12 will be free-standing or mounted to an adjacent structure.

For use on a substantially unyielding surface, such as concrete, asphalt, tile, or carpet, the device 10 is provided with a flat base attachment 106 for stabilizing the housing 12 without damaging the surface material. The attachment 106 includes a conventional male pipe adapter 108 (identical to those described above) that is mounted to a short pipe segment 110 that is filled with cured concrete (now shown) or another massive, hard material. The attachment 106 threadedly engages the third female pipe adapter 46 on the bottom of the housing 12. A round weight pad 112, having a diameter equal to the interior diameter of the short pipe segment 110, is fastened to the top surface of the concrete preferably with silicon adhesive. The weight pad 112 absorbs the impact of the weight when it descends the bottom of the housing 12. A round base pad 114 that is preferably identical to the weight pad 112 is fastened to the bottom surface of the concrete with silicon adhesive. The base pad 114 is provided for protecting the surface upon which the housing is seated from being scratched or scuffed. The base pad 114 also provides frictional engagement between the housing 12 and the surface to prevent the lower end of the housing from sliding. The pads 112 and 114 are formed of rubber padding, although any other pliable, shock absorbent material, such as carpet or foam padding, is contemplated.

Figure 9:
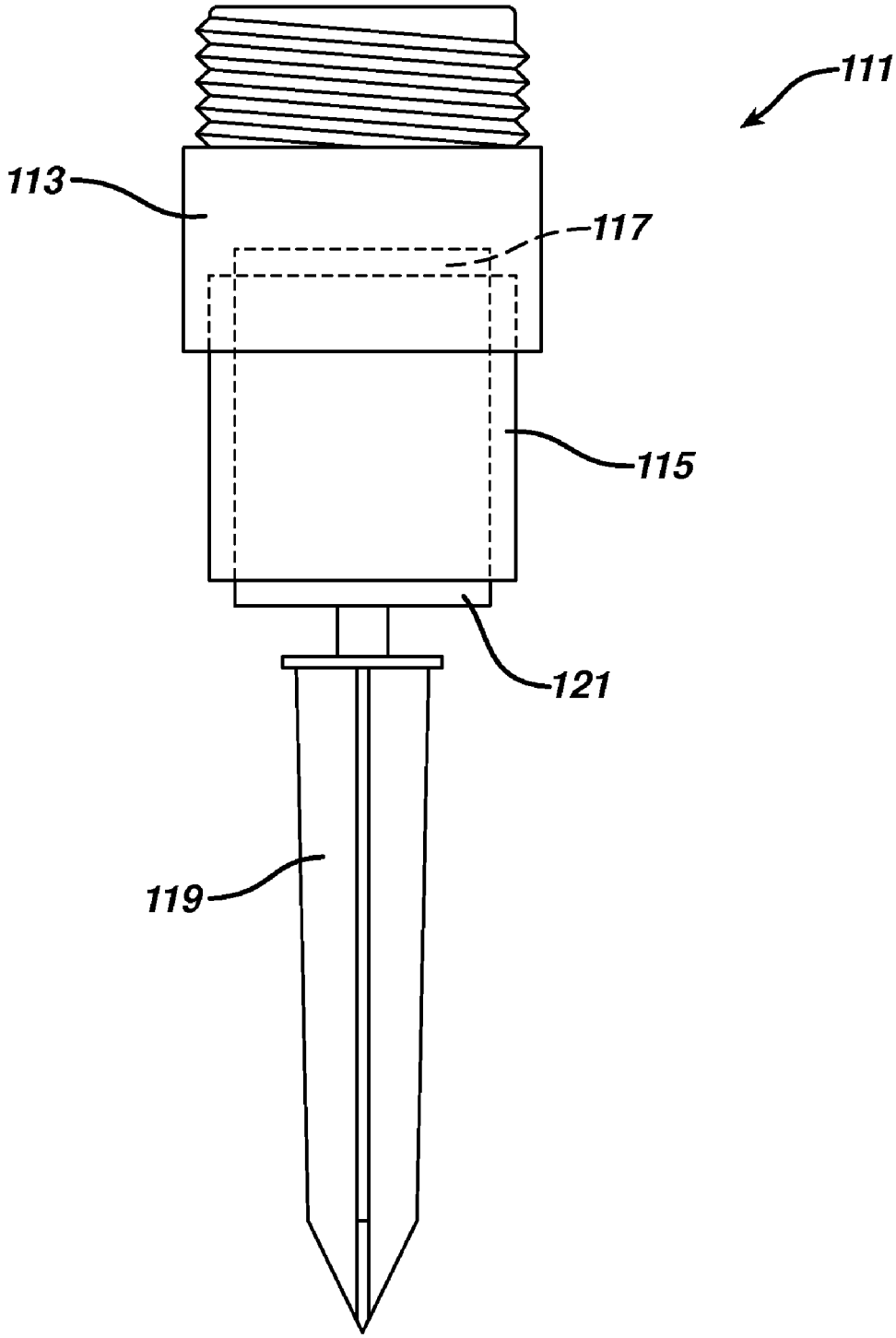
FIG. 9 is a front elevation view illustrating the spike attachment of the present invention.

For use on easily penetrable surfaces, such as grass and soil, the housing is provided with a spike attachment 111 for securing the base of the housing 12, as shown in FIGS. 6 and 9. Like the flat base attachment, the spike attachment 111 includes a conventional male pipe adapter 113 (identical to those described above) mounted to a short pipe segment 115 that is filled with concrete. Also like the flat base attachment, a weight pad 117 is fastened to the top surface of the concrete filling with silicon adhesive. The attachment 111 also includes a steel spike 119 having a flat mounting plate 121. The mounting plate 121 is fastened to the bottom surface of the concrete filling with silicon adhesive. The spike 119 measures 10 inches in length, although longer or shorter spikes are contemplated.

The spike attachment 111 mounts to the housing 12 in a manner identical to the flat base attachment 106. During use, the spike 119 is driven into the ground until the mounting plate 121 is flush with the ground, thus securing the base of the housing 12 against lateral movement.

Figure 5:
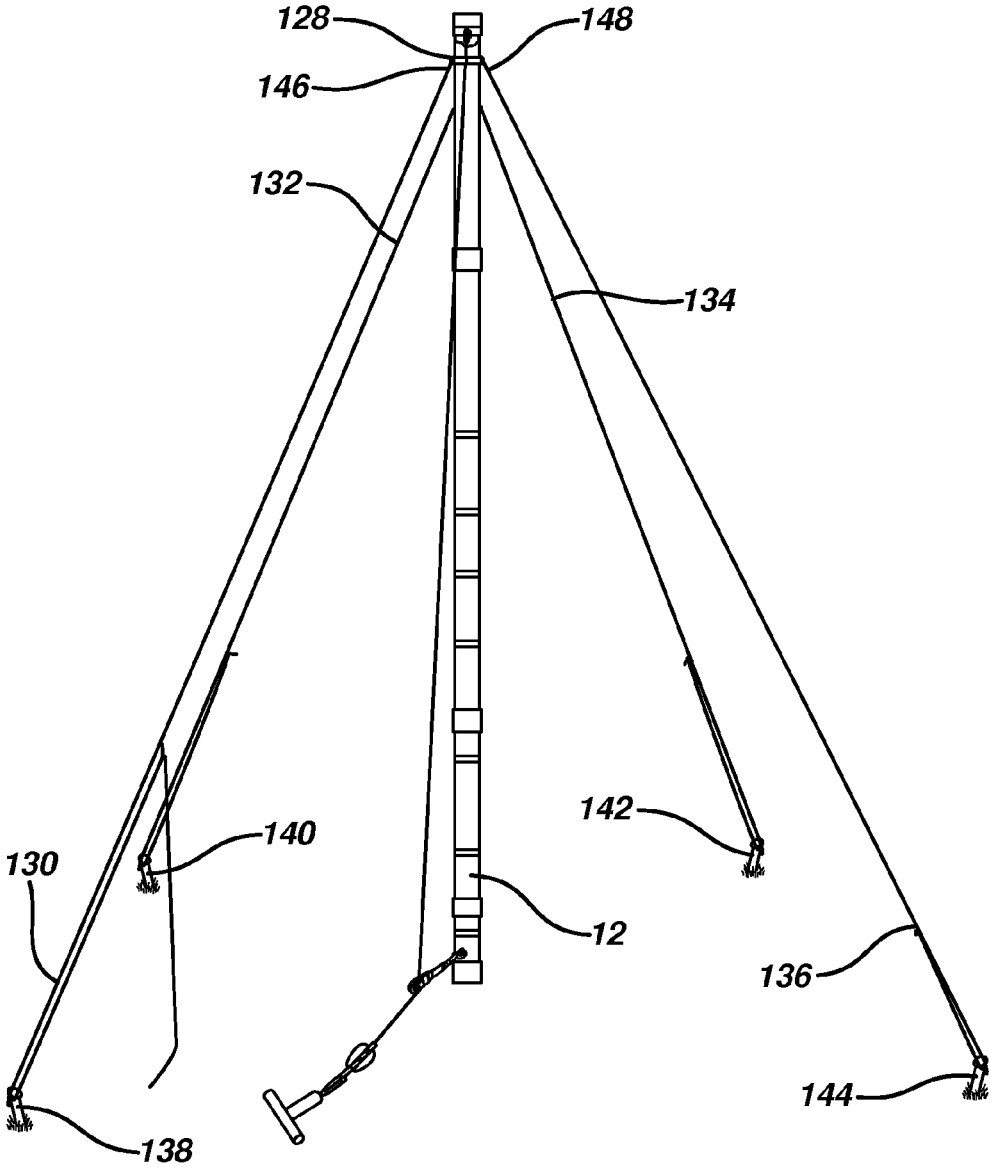
FIG. 5 is a perspective view illustrating an embodiment of the present invention in a free-standing configuration.

For using the device 10 in a free-standing configuration, such as in an open field, there are provided four mounting rings 120, 122, 124, and 126 (ring 126 is not within view, but is identical to rings 120-124) that are secured to the housing by a nylon mounting collar 128, as shown in FIGS. 2 and 5. The mounting collar is positioned on the top segment 28 of the housing 12 adjacent the bottom of the pulley aperture 48. The collar 128 and the rings 120-126 are substantially identical to the fasting rings 86-98 and fastening collars 72-84 described above, except that the mounting collar 128 is affixed to the housing 12, such as with silicon adhesive. The mounting rings 120-126 are radially spaced 90 degrees apart from one another. Four tie-down ropes 130, 132, 134, and 136 terminating in ground stakes 138, 140, 142, and 144 are connected to the mounting rings 120-126 with conventional bolt snaps 146, 148, 150, and 152 (bolt snaps 150 and 152 are not within view, but are identical to snaps 146 and 148). During use, each of the tie-down ropes 130-136 is drawn taught and each of the ground stakes 138-144 is planted in the ground about 10 feet from the base of the housing 12. The housing 12 is thus laterally secured in the manner of a ship's mast or a tent pole.

Figure 7:
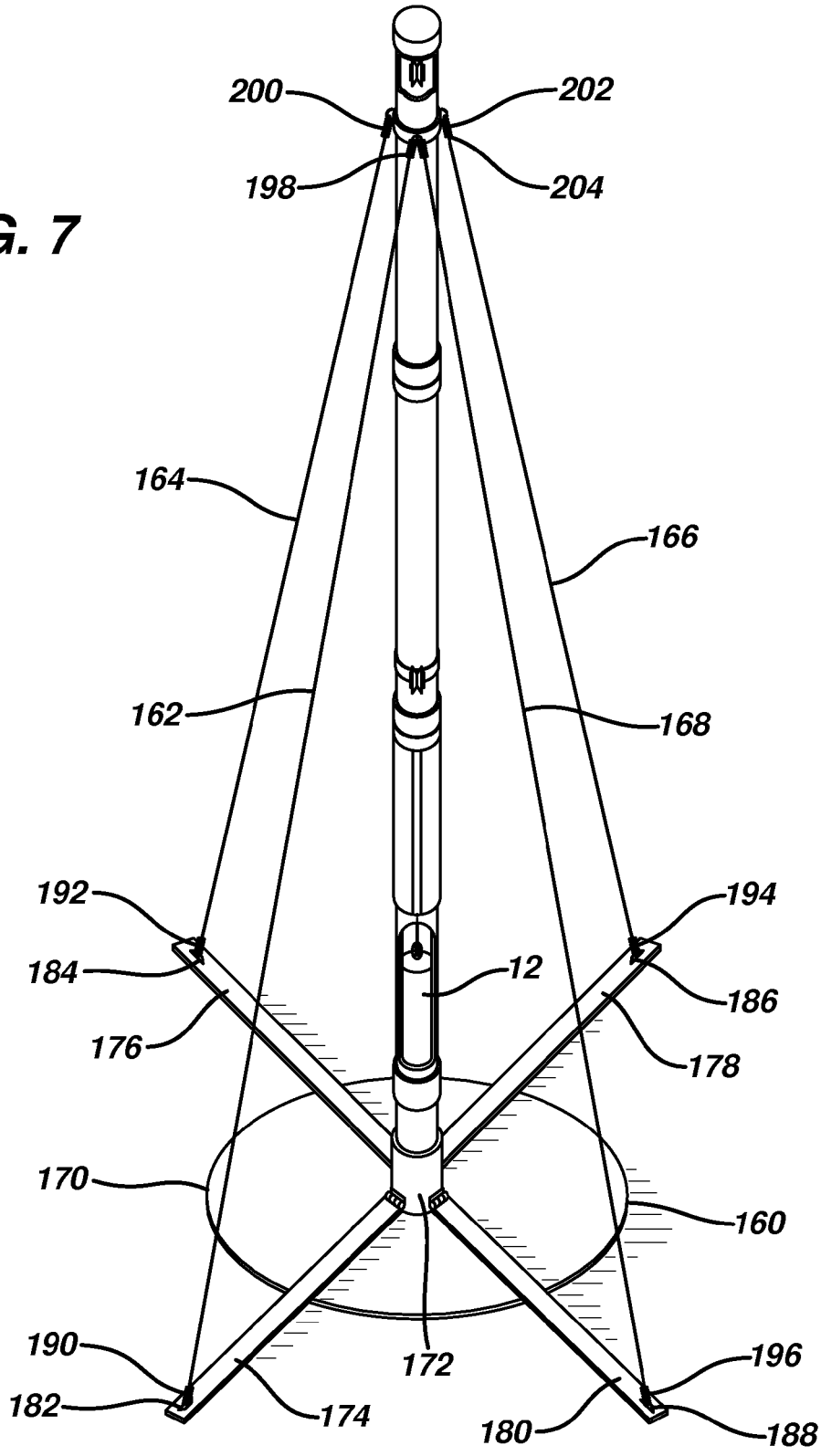
FIG. 7 is a perspective view illustrating an embodiment of the present invention in an alternative free-standing configuration with a portable base.

In an alternative method for securing the device 10 in a free-standing configuration, there is provided a mounting base 160 and four tie-down ropes 162, 164, 166, and 168, as shown in FIG. 7. The mounting base 160 is formed of steel and includes a base plate 170, a mounting cuff 172, and four stabilizing legs 174, 176, 178, and 180. The base plate 170 is a flat, circular body that is 3 feet in diameter, although plates having other shapes and sizes are contemplated. The mounting cuff 172 is cylindrical and extends upwardly from the center of the base. The cuff 172 has an inner diameter that is substantially equal to the outer diameter of the base attachment 106, and has a length that is substantially equal to the length of the base attachment 106.

The stabilizing legs 174, 176, 178 and 180 are hingedly mounted to the top surface of the base plate 170 and extend radially outwardly about 3 feet beyond the perimeter of the plate 170. The legs 174-180 are spaced 90 degrees apart from one another and can be locked in an extended position for use, and can be unlocked and folded upwardly for transporting the base 160. Four D-rings 182, 184, 186 and 188 are rigidly mounted to the top surfaces of the distal ends of the legs 174-180 for attachment of the tie-down ropes 162-168, which are similar to the tie-down ropes 130-136 described above, but each rope terminates in a conventional bolt snap (190, 192, 194, 196, 198, 200, 202, and 204) on each of its ends.

During use, the base attachment 106 of the housing 12 is coaxially mounted within the mounting cuff 172, thus holding the housing 12 in an upright orientation. Each tie-down rope (162-168) is drawn taught and is fastened on one end to one of the D-rings (182-188), and is fastened on the other end to one of the mountings rings (see 120-126 in FIG. 2). The base plate 170, legs 174-180, and tie-down ropes 162-168 thus provide the housing 12 with lateral stability. For additional stability, it is contemplated that the top end of the housing can be mounted to an optional ceiling cuff (not shown). The ceiling cuff is substantially identical to the mounting cuff, but is rigidly mounted to a ceiling or another overhead surface by a bracket for securing the top of the housing 12.

For using the device adjacent a fixed structure, such as a fence, a door, or a pole, the device 10 is provided with two pairs of adjustable nylon tie-down straps 210 and 212 for mounting the device to the structure, as shown in FIG. 4. One pair of straps 210 extends from the housing 12 adjacent the bottom end of the top segment 28, and the other pair of straps 212 extends from the housing 12 adjacent the bottom end of the bottom segment 24. The straps 210 and 212 are wrapped around a structure, and then they are secured with clasps (not within view) or tied together. Although nylon straps are preferred, all other means of removably mounting the housing to an adjacent structure, such as with ropes, bungie cords, conventional fasteners or brackets, are contemplated. It is further contemplated that a greater number of straps may be used than shown.

Figure 8:
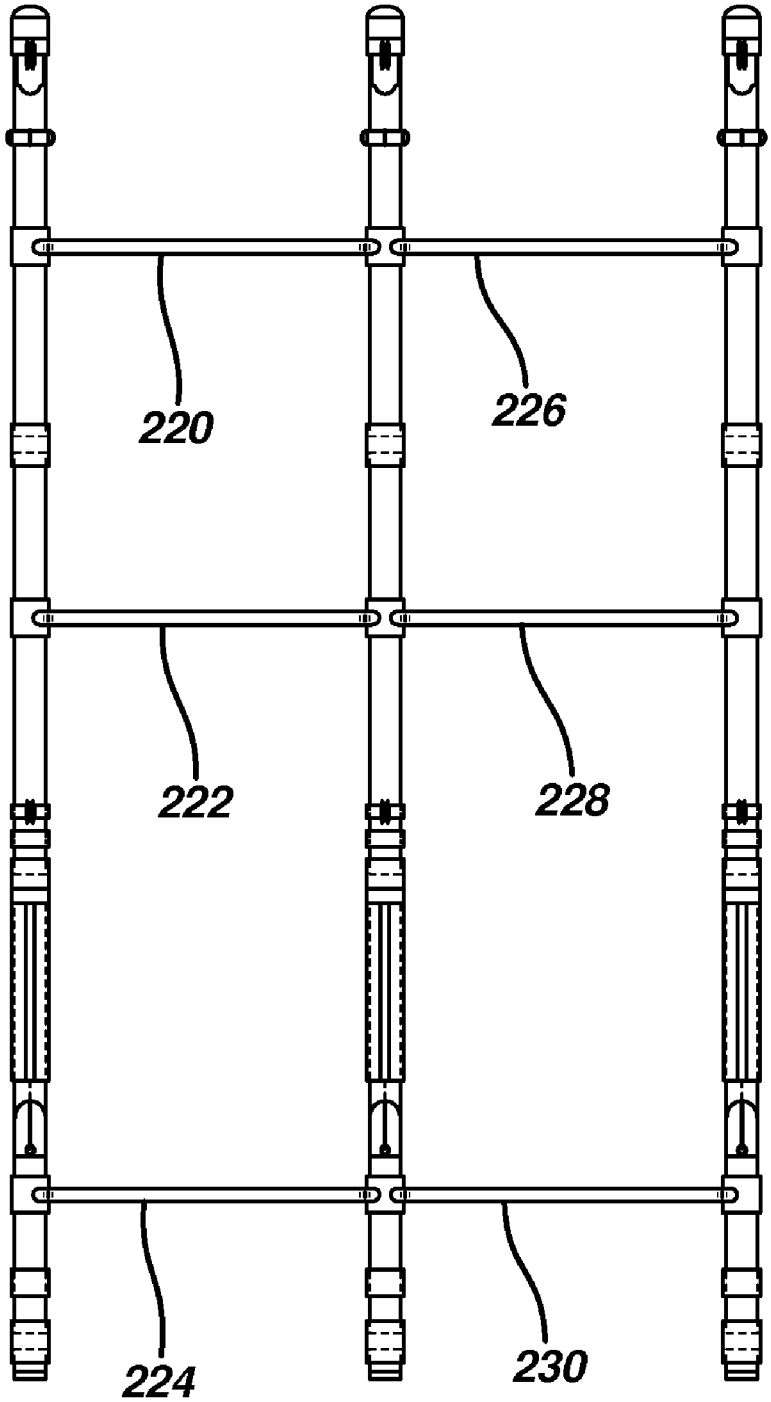
FIG. 8 is a front elevation view illustrating several housings of the present invention connected by brackets in a supportive configuration.

In any of the above described configurations, it is contemplated that several of the devices can be set up adjacent one another and connected to one another by a series of removable brackets 220, 222, 224, 226, 228, and 230 (see FIG. 8) for providing all of the devices with additional stability while also allowing several users to exercise within close proximity of each other. It is further contemplated that several of the devices may laterally buttress one another in an outwardly facing configuration for the same purpose.

The following example illustrates the typical operation of the device 10 on a penetrable surface adjacent a fixed structure: the unassembled device 10 (shown in FIG. 4) is carried in a duffel bag to a location such as a baseball field. A user removes the various components of the device 10 from the bag and assembles them with the spike attachment 111 (shown in FIG. 9) being mounted to the bottom of the housing 12.

The spike 119 is driven into the ground adjacent a fence with the first pulley 14 being directed away from the fence (as shown in FIG. 6). The tie-down straps 210 and 212 are then used to tightly fasten the housing 12 to the fence. The bolt snap 102 (shown in FIG. 2) of the second pulley 22 is attached to the bottom-most fastening ring 98. The flexible member 18 is placed in engagement with the top of the first pulley 14 and the bottom of the second pulley 22 and is directed upwardly to the user interface 20 in the hand of a user.

To perform a bicep curl, the user grips the user interface 20 with his palm facing the housing and his arm extending downwardly. As the user urges the interface 20 upwardly by bending his arm at the elbow, the force applied by the user is transmitted through the flexible member 18 and the pulleys 14 and 22 to the weight 16, thus lifting the weight 16 against the force of gravity and to move upwardly within the housing 12. When the user extends his arm back downwardly, gravity causes the weight 16 to descend within the housing 12. The upward and downward movement of the interface 20 is repeated in a conventional manner to perform the exercise. After completing his workout, the user disassembles the device 10 and returns its components to the duffel bag for transport.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A portable weightlifting apparatus comprising:

(a) an elongated housing that is separable into at least two axial segments;

(b) a first aperture formed in the housing adjacent a first end of the housing;

(c) at least one weight slidably disposed within the housing;

(d) a flexible member extending from said at least one weight through the first aperture and terminating in a user interface outside of the housing;

(e) a first pulley mounted to the housing adjacent the first aperture for operatively engaging the flexible member;

(f) a second pulley for operatively engaging the flexible member between the first pulley and the user interface;

(g) a second aperture formed in the housing adjacent a second end of the housing for allowing access to said at least one weight, the second aperture being large enough for said at least one weight to pass through; and (h) a removable cover positioned over the second aperture, the cover comprising a shim and a retaining collar slidably mounted around an exterior of the housing for slidably engaging the housing.

* * * * *